US011302120B2

(12) United States Patent
Hößle et al.

(10) Patent No.: US 11,302,120 B2
(45) Date of Patent: Apr. 12, 2022

(54) UTILITY VEHICLE MONITORING SYSTEM

(71) Applicant: SAF-HOLLAND GmbH, Bessenbach (DE)

(72) Inventors: Florian Hößle, Österreich (AT); Nicolas Pütz, Bessenbach (DE)

(73) Assignee: SAF-Holland GmbH, Bessenbach (DE)

( * ) Notice: Subject to any disclaimer, the term of this patent is extended or adjusted under 35 U.S.C. 154(b) by 157 days.

(21) Appl. No.: 16/574,911

(22) Filed: Sep. 18, 2019

(65) Prior Publication Data

US 2020/0090423 A1 Mar. 19, 2020

(51) Int. Cl.

| | |
|---|---|
| ***G07C 5/00*** | (2006.01) |
| ***G07C 5/02*** | (2006.01) |
| ***G07C 5/08*** | (2006.01) |
| ***G08G 1/00*** | (2006.01) |

(52) U.S. Cl.
CPC ..... *G07C 5/008* (2013.01); *G07C 5/02* (2013.01); *G07C 5/0825* (2013.01)

(58) Field of Classification Search
USPC ..... 701/31.4
See application file for complete search history.

(56) References Cited

U.S. PATENT DOCUMENTS

| | | | | |
|---|---|---|---|---|
| 2005/0016787 | A1* | 1/2005 | Lesesky | G07C 5/008 180/311 |
| 2008/0312786 | A1* | 12/2008 | Day | G07C 5/008 701/31.4 |
| 2018/0224844 | A1 | 8/2018 | Zhang et al. | |
| 2019/0184950 | A1* | 6/2019 | Williams | B60T 7/20 |
| 2019/0359196 | A1* | 11/2019 | Engelbert | B60C 23/20 |
| 2020/0118361 | A1* | 4/2020 | Zula | G07C 5/0808 |
| 2021/0061028 | A1* | 3/2021 | Da Deppo | B60C 23/127 |

FOREIGN PATENT DOCUMENTS

| | | |
|---|---|---|
| DE | 10319493 | 11/2003 |
| DE | 102017002305 | 9/2017 |
| EP | 3144162 | 3/2017 |

* cited by examiner

*Primary Examiner* — Tyler D Paige
(74) *Attorney, Agent, or Firm* — Price Heneveld LLP

(57) ABSTRACT

A utility vehicle monitoring system includes a utility vehicle subsystem and a central system, wherein the utility vehicle subsystem is configured to be arranged proximate a part of a utility vehicle, wherein the central system includes a processing unit and an information transmission unit, wherein the central system is positioned independently of the utility vehicle, wherein the utility vehicle subsystem includes a transmitter unit, a receiver unit, a processing system and a sensor system, wherein the sensor system is configured to record at least one dynamic vehicle characteristic value and transmit the value to the processing system, wherein the transmitter unit and the receiver unit are configured to transmit the at least one dynamic vehicle characteristic value from the processing system to the central system.

22 Claims, 1 Drawing Sheet

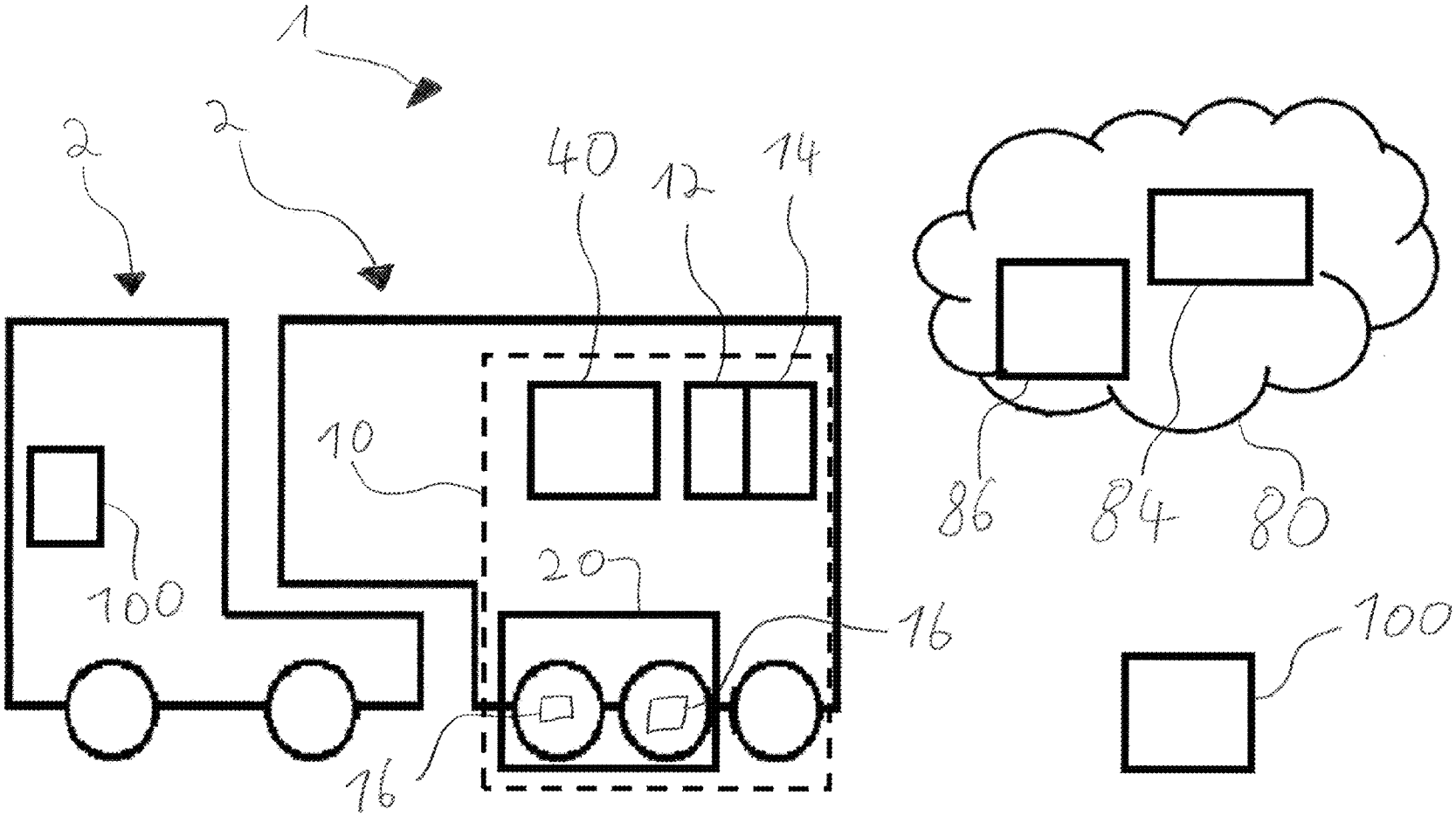
1
2
2
10
12
14
16
16
20
40
80
84
86
100
100

UTILITY VEHICLE MONITORING SYSTEM

CROSS REFERENCE TO RELATED APPLICATION

This application claims priority to the German Patent Application No. 10 2018 122 879.1, filed on Sep. 18, 2018, which is incorporated herein by reference in its entirety.

BACKGROUND OF THE INVENTION

The invention relates to a utility vehicle monitoring system, in particular for a utility vehicle trailer.

The prior art already discloses vehicle monitoring systems that serve to monitor the state of individual components of the vehicle. By way of example, such a vehicle monitoring system may be used to monitor the state of the brake linings. The systems known from the prior art in this case have a few disadvantages. By way of example, it may be the case in the systems known from the prior art that the driver is distracted by the information that is provided and/or that the driver ignores important information from the vehicle monitoring system, such that the downtimes of the utility vehicle are at least not able to be reduced using the monitoring system.

The object of the present invention is therefore to provide a utility vehicle monitoring system that has a high degree of operational convenience and furthermore also reduces the downtimes of the utility vehicle.

SUMMARY OF THE INVENTION

According to the invention, a utility vehicle monitoring system, in particular utility vehicle trailer monitoring system, comprises a utility vehicle subsystem and a central system, wherein the utility vehicle subsystem is arranged and/or is able to be arranged on and/or at a part of a utility vehicle, in particular a utility vehicle trailer, wherein the central system comprises a processing unit and an information transmission unit, wherein the central system is positioned independently of the utility vehicle, wherein the utility vehicle subsystem comprises a transmitter unit, a receiver unit, a processing system and a sensor system, wherein the sensor system is designed to record at least one measured value, in particular a dynamic vehicle characteristic value, and transmit it to the processing system, wherein the transmitter unit and the receiver unit are designed to transfer or to transmit data, in particular the measured values and/or the dynamic vehicle characteristic values, from the processing system to the central system. The utility vehicle monitoring system according to the invention serves in particular to be able to monitor one or a multiplicity of devices present on the utility vehicle. A utility vehicle within the meaning of this invention may in particular be considered to be a roadworthy vehicle whose overall weight is in particular above 3.5 t, preferably above 7 t and very particularly preferably above 12 t. The utility vehicle subsystem of the utility vehicle monitoring system is preferably arranged at least on a part of a utility vehicle, very particularly preferably completely on a utility vehicle; the utility vehicle is in this case in particular a utility vehicle trailer. The utility vehicle subsystem in this case has a sensor system that serves to record measured values. These measured values may in particular be dynamic vehicle characteristic values. Dynamic vehicle characteristic values are in this case values that change, in particular continuously over time, depending on the usage state and/or the wear state and/or the driving state. By way of example, dynamic vehicle characteristic values may be the position of the utility vehicle, the wheel bearing temperature, the current tire pressure, the wear state of the brake system and/or of its subcomponents (brake disk, brake drum and/or brake linings), the speed and the acceleration of the utility vehicle, the position of possible support winches on the utility vehicle, the loading of the axles of the utility vehicle, the pressure in the possible air springs of the utility vehicle, an energy state in an energy storage device (for example compressed air tank and/or battery), the position of the individual axles of the utility vehicle relative to a body of the utility vehicle (for example lifting axles), the fill level of storage tanks (for example brake fluid compensation tank and/or oil level) and/or the brake pressure. To determine these measured values and/or the dynamic vehicle characteristic values, the sensor system preferably has at least one sensor. Such a sensor may be formed for example by a GPS unit, a temperature sensor, a strain gauge, a piezo element, a pressure sensor, a voltage meter and/or an ammeter. The measured value recorded by the sensor system may be transmitted to the processing system within the utility vehicle subsystem in particular by line(s) and/or by radio transmission units. In other words, the sensor system is in particular connected in terms of information to the processing system. The processing system of the utility vehicle subsystem serves to process and/or to forward the measured values. By way of example, the calibration information belonging to a sensor and/or the sensor unit are stored and/or able to be retrieved in the processing system. In other words, the processing system of the utility vehicle subsystem may be designed to convert the voltage signal transmitted by the sensor system into an "actually present"/actual measured value. By way of example, the processing system serves to convert the voltage signal determined by a temperature sensor in the sensor system into an actually present temperature. The processing system is advantageously connected to the transmitter unit and the receiver unit of the utility vehicle subsystem in terms of information, for example by cables and/or by a radio connection, such that the processing system is able to transmit data to the transmitter unit and/or is able to receive data from the receiver unit. In other words, this may mean that the processing system is capable of communicating with the transmitter unit and the receiver unit in terms of data, in particular such that the measured signals and/or the dynamic vehicle characteristic values are able to be transmitted to the transmitter unit. The transmitter unit of the utility vehicle subsystem serves to transmit information, in particular the measured values and/or the dynamic vehicle characteristic values, to another system, in particular the central system. The receiver unit on the other hand serves to receive data from another system, in particular the central system. The central system of the utility vehicle monitoring system-in contrast to the utility vehicle subsystem—is positioned independently of the utility vehicle. Positioned independently of the utility vehicle may preferably be understood to mean that this utility vehicle-independent system does not move along with the utility vehicle. The central system is in particular a central and/or decentralized server-implemented system that may be arranged in a spatially fixed manner. The central system may for example be cloud-based. As an alternative and/or in addition, a system is preferably "positioned independently of the utility vehicle" when it is not situated on any vehicle, in particular any utility vehicle. The central system has at least a processing unit and an information transmission unit. The information transmission unit serves in particular to receive data from the transmitter unit of the utility vehicle subsystem and/or to transmit data to the receiver unit of the utility vehicle subsystem. This transmission of data between the central system and the utility vehicle subsystem in this case takes place in particular wirelessly and/or in a wired manner. By way of example, this transmission of data may in this case take place using satellite systems, WLAN, mobile radio networks and/or the Internet. In addition to the information transmission unit, the central system also comprises a processing unit, which may serve, inter alia, to process or to store the data received from the information transmission unit and/or to transmit data to the information transmission unit, these advantageously having been stored and/or processed beforehand in the processing unit. By way of example, the processing unit may in this case have storage modules and/or computer units in order inter alia to process the received data and/or to create instructions for the information transmission unit. In other words, this may mean that the processing unit is a computer unit that may have for example one or a multiplicity of CPUs, a memory in the form of working memory and/or a mass memory (for example hard disk). The central system preferably also has another data output by way of which the data present in the central system, in particular the data stored in the processing unit, are able to be transmitted to a user and/or the data output is designed to receive certain instructions from a user in order to forward the data thereto; the data output is in particular a part of the information transmission unit of the central system. By virtue of the possibility of centrally processing and storing the measured values of the utility vehicle in the central system, it is possible firstly to greatly increase operational convenience and secondly it is thereby possible to provide the data determined in the utility vehicle to external users, and these data may additionally also be analyzed in order for example to be able to reliably predict the servicing requirements and/or the possibility of future failures of components of the utility vehicle. Predicting failures and/or determining the servicing state of the utility vehicle may be performed for example using a model-based method and/or through the use of a neural network. The utility vehicle monitoring system according to the invention thus has a high degree of operational convenience, and the utility vehicle monitoring system is furthermore also capable of reducing the downtimes of the utility vehicle.

The sensor system is preferably designed to record at least a multiplicity of measured values, in particular dynamic vehicle characteristic values. Recording a multiplicity of measured values in this way in this case has the advantage inter alia that a significantly greater ability to monitor the utility vehicle is thereby achieved since, by correlating different measured values, it is in particular possible to obtain further information about the operating state of the utility vehicle. This multiplicity of measured values may be transmitted to the information transmission unit by the transmitter unit, in particular in a parallel transmission method and/or a sequential transmission method. As an alternative and/or in addition, the various measured values are determined at different sampling frequencies, in order thus to reduce the amount of data to be recorded. In other words, this may mean that for example measured values, such as the frequency of a vibration, are recorded at a higher sampling frequency than for example the temperature prevailing in a wheel bearing. It is particularly preferable in this case for the processing system of the utility vehicle subsystem to continuously check the recorded measured data for anomalies, such as for example the exceedance of a maximum permissible value. The result of this "anomaly monitoring" is preferably determined at short time intervals (high frequency), in particular at the latest every 10 seconds, and/or transmitted to the central system by way of a check bit and/or byte that indicates whether an anomaly is present and/or not. It is thereby possible, with a particularly low amount of data, to continuously monitor the most important information with regard to the utility vehicle state and/or to transmit this information to the central system using only a low amount of data. The (actually) recorded measured values themselves (raw data and/or compressed raw data) may in this case be transmitted such that they are transmitted continuously to the central system by the transmitter unit and/or discontinuously, in particular only following the reception of a transmit request. It is also conceivable for example for certain measured values to be transmitted continuously and other measured values to be transmitted only discontinuously in order to keep the volume of data to be transmitted as low as possible and to thus save costs and energy. The transmission of data may particularly preferably also take place such that the measured values are transmitted discontinuously and/or continuously and that different transmit channels, in particular carrier frequencies, are used for respectively different measured values. A particularly high transmission rate is thereby able to be ensured.

Expediently, the processing system codes the data transmitted to the transmitter unit and/or the processing system decodes the data received from the receiver unit. A particularly reliable transmission of data is able to take place by virtue of this coding and/or decoding. As an alternative and/or in addition, the processing system may preferably compress the data transmitted to the transmitter unit and/or decompress the data received from the receiver unit. It is thereby possible firstly to reduce the required memory space and secondly to reduce the transmission time for the data, such that it is possible to save time and costs. This compression may in this case take place both using loss-free procedures and using loss-free compression procedures. The respective compression procedure is in this case particularly preferably adapted to the existing measured values. Measured values that are recorded in the frequency range of 20 Hz to 10 kHz are particularly preferably compressed in this case, in particular by way of an MP3 codec, in order thus to save memory space and transmission time.

Static vehicle characteristic values are advantageously stored in the processing system, wherein the utility vehicle subsystem transmits and/or is designed to transmit the static vehicle characteristic values to the central system, in particular following the reception of a request. By virtue of the processing system storing and/or providing the static vehicle characteristic values, it is possible for the utility vehicle subsystem to be able to access a highly comprehensive information state of the utility vehicle and/or to be able to transmit this. In other words, a kind of digital vehicle passport of the utility vehicle is stored in the processing system. These static vehicle characteristic values may serve for example as a basis for "limits" for determining anomalies and/or patterns, for example comparing a permissible axle load to an actually present axle load. Static vehicle characteristic values are in particular the characteristic values of the utility vehicle at which and/or on which the utility vehicle subsystem is arranged and that change only over a long period of time and/or are not dependent on the usage and/or the wear and/or the driving state. By way of example, static vehicle characteristic values are the registration number of the utility vehicle, the construction year, the maximum (axle) load, the power of the utility vehicle, the length of the utility vehicle, the height of the utility vehicle, the width of the utility vehicle, the number of axles, the date of the next and/or last servicing, the last and/or the next date for the main inspection and/or the type of brakes that are installed and/or the number and/or the type of the measured values recorded by the sensor system. By combining the measured values, in particular the dynamic vehicle characteristic values, and the static vehicle characteristic values in this way, it is thus possible to deliver or to achieve highly comprehensive monitoring of the utility vehicle, in particular already on the utility vehicle/utility vehicle subsystem. As an alternative or in addition, the static vehicle characteristic values may preferably also be stored in the central system, in particular the processing unit. The amount of data present on the utility vehicle subsystem is thereby able to be reduced, such that it is possible in particular to use a processing system in the utility vehicle subsystem that needs to have a smaller memory, such that costs are able to be saved.

The sensor system preferably has a multiplicity of sensors, wherein the sensors each record at least one dynamic vehicle characteristic value. The utility vehicle is thereby able to be monitored in a particularly comprehensive manner since the various dynamic vehicle characteristic values may in particular be used to detect an incorrect function and/or be used to detect the failure of components early (earlier). This multiplicity of recorded measured data additionally also offers the advantage that, by linking and/or correlating a plurality of dynamic vehicle characteristic values, it is also possible to draw conclusions regarding further variables that are for example not able to be measured.

The central system preferably transmits data from and/or to at least one information display unit using the information transmission unit and/or is designed to transmit data from and/or to at least one information display unit. The information display unit may be for example a part of the utility vehicle, of the central system and/or a system independent of this system. By way of example, the information display unit may be a computer system having a display unit, in particular a screen, which is arranged for example in the haulage company or a fleet management apparatus. As an alternative or in addition, the information display unit may preferably also be for example a mobile telephone, a tablet and/or another screen that is able to display the transmitted images. By virtue of the ability to transmit data between the central system and the information display unit, the data present in the central system are easily able to be displayed to a user. This user may in this case be for example the driver of the utility vehicle and/or the haulier of the utility vehicle and/or a fleet manager. The data transmitted by the central system to the information display unit may in this case be information that describes the dynamic and/or the static vehicle characteristic values and/or the overall state of the utility vehicle. The information display unit therefore easily makes it possible for a user, in other words, to monitor and/or to detect the currently present state of the utility vehicle. The central system is particularly preferably designed or configured such that it is able to transmit data from and/or to a multiplicity of information display units using the information transmission unit. The transmission between the information transmission unit and the information display unit(s) in this case preferably takes place in encrypted and/or compressed form.

The processing unit is expediently designed inter alia to recognize patterns and/or anomalies in the received data, wherein the processing unit is designed, when such a pattern and/or such an anomaly is present in the received data, to transmit an action recommendation signal to the information transmission unit, wherein the information transmission unit transmits the action recommendation signal to the utility vehicle subsystem and/or to the information display unit. "Received data" are understood in particular in this case to mean the data that the central system receives from the utility vehicle subsystem. In other words, data are understood in this context to mean in particular the measured values, the dynamic vehicle characteristic values and/or the static vehicle characteristic values of the utility vehicle. The patterns and/or anomalies to be recognized in the data, in particular measured data, may in this case for example be the exceedance of a maximum value and/or of a minimum value of the data and/or a deviation of the data. This pattern recognition by the processing unit may in this case be performed both using a deterministic system, such as for example a model-based system, and/or the pattern recognition may in addition preferably be performed using a neural network. If this pattern recognition system should recognize a certain pattern or an anomaly in the data, then the processing unit may determine a certain action recommendation on the basis of the detected pattern and/or the detected anomaly and transmit an action recommendation signal, corresponding to this action recommendation, to the information transmission unit. In other words, this may mean that the action recommendation signal corresponds to the action recommendation determined in the processing unit and/or represents same. This action recommendation signal may be transmitted to the utility vehicle subsystem and/or to the information display unit by the information transmission unit. The action recommendation signal may in this case for example represent the action recommendation that the utility vehicle should be serviced, that the utility vehicle should be taken to a garage and/or that the utility vehicle should be stopped immediately. By virtue of transmitting the action recommendation signal to the utility vehicle subsystem and/or to the information display unit, information is easily and effectively able to be provided to the user and/or, by virtue of the utility vehicle subsystem acting on components of the utility vehicle, the action recommendation determined by the central system is able to be implemented directly.

The utility vehicle monitoring system, in particular the utility vehicle subsystem and/or the central system, advantageously has a software interface and/or a hardware interface, in particular for a third-party provider. In other words, the utility vehicle monitoring system may be provided such that it has a hardware interface and/or a software interface, in particular for third-party providers, such that the utility vehicle monitoring system is also equipped for future expansions. By virtue of providing this hardware and/or by virtue of the software interface, the utility vehicle monitoring system is therefore easily able to be expanded, such that the utility vehicle monitoring system is in particular able to be adapted to future situations (which are possibly as yet unknown). By way of example, such a hardware interface may be a plug system and/or a plug system for further sensors and/or processing units and/or processing systems and/or sensor systems and/or transmitter and receiver units. The software interface may in particular be implemented such that it is implemented in an object-oriented manner, such that a high degree of adaptability of the software interface is achieved by using class structures.

The utility vehicle subsystem advantageously has an interface for further sensor systems and/or sensors, in particular a plug and/or a socket. The utility vehicle monitoring system is thereby easily able to be expanded with further sensors and/or sensor systems in order thereby to expand the information that is provided and therefore also the monitoring of the utility vehicle. These plugs and/or sockets of the utility vehicle subsystem, of the sensor system and/or of the sensors are in this case in particular designed such that these plugs take over both the transmission of information and the supply of energy to the sensor systems and/or the sensors.

Parts of the utility vehicle monitoring system, in particular the utility vehicle subsystem and/or a sensor system and/or a sensor, are preferably manufactured and/or marketed by another manufacturer and/or another provider than that of the utility vehicle and/or of the/of another part of the utility vehicle subsystem. In other words, this may mean that the utility vehicle monitoring system may be used not only by its manufacturer, such as for example SAF Holland®, but rather that other providers of utility vehicles and/or parts of utility vehicles and/or sensor systems and/or sensors may also manufacture and/or market parts of the utility vehicle monitoring system, such that a particularly high degree of adaptability of the utility vehicle monitoring system and thus also of the utility vehicle monitoring is able to be achieved.

A further aspect of the invention may also relate to a method for monitoring a utility vehicle, in particular a utility vehicle trailer. This method in this case advantageously makes use of a utility vehicle monitoring system as described above and/or in this case comprises at least one of the method steps described above in connection with the utility vehicle monitoring system.

Further advantages and features of the present invention will emerge from the following description with reference to the figure. Individual features of the illustrated embodiment may in this case also be used in other embodiments, unless this has been expressly ruled out.

BRIEF DESCRIPTION OF THE DRAWINGS

The figures are as follows:

FIG. 1 shows a schematic view of a utility vehicle monitoring system.

DESCRIPTION OF THE PREFERRED EMBODIMENTS

FIG. 1 shows a utility vehicle monitoring system 1. The utility vehicle monitoring system 1 in this case serves to monitor the utility vehicle 2. In the embodiment illustrated in FIG. 1, the utility vehicle monitoring system 1 serves to monitor the utility vehicle trailer 2. The utility vehicle monitoring system 1 in this case has a utility vehicle subsystem 10 and a central system 80.

The utility vehicle subsystem 10 contains at least a processing system 40, a transmitter unit 12, a receiver unit 14 and a sensor system 20. In the embodiment illustrated in FIG. 1, the sensor system 20 has two sensors 16 that serve to determine the wheel bearing temperature and the vibration of the axles and the axle load of the utility vehicle trailer 2. The sensor system 20 may transmit the sensor values or measured data determined thereby to the processing system 40 of the utility vehicle subsystem 10 in a wired and/or wireless manner, for example using radio waves. The processing system 40 may for example process or store the data and/or transmit them to the transmitter unit 12, which dispatches the data, in particular to the information transmission unit 86 of the central system 80.

The central system 80 has not just one information transmission unit 86, but rather also at least a processing unit 84. The data received by the information transmission unit 86, in particular measured values and/or data of the transmitter unit 12, may be forwarded in the central system 80 to the processing unit 84 and in particular be stored, processed and/or interpreted there. Pattern recognition and/or anomaly recognition is in particular implemented in the processing unit 84, which pattern recognition and/or anomaly recognition may serve inter alia to establish certain anomalies in order thus inter alia to be able to determine and/or derive the currently present utility vehicle state. The data present in the processing system 84 may be transmitted to the information display unit 100 by the information transmission unit 86. In the embodiments illustrated in FIG. 1, the information transmission units 100 are firstly a screen in the traction vehicle 2 and secondly a fleet management system 100.

As an alternative or in addition, the information from the information transmission unit 86 may also preferably be transmitted to the receiver unit 14 of the utility vehicle subsystem 10 and forwarded there within the utility vehicle subsystem 10 to the processing system 40 for further processing in a wired manner and/or wirelessly.

LIST OF REFERENCE SIGNS

1—Utility vehicle monitoring system
2—Utility vehicle
10—Utility vehicle subsystem
12—Transmitter unit
14—Receiver unit
16—Sensor
20—Sensor system
40—Processing system
80—Central system
84—Processing unit
86—Information transmission unit
100—Information display unit

The invention claimed is:

1. A remote monitoring system for a utility vehicle, comprising:

a utility vehicle subsystem; and a central system;

wherein the utility vehicle subsystem is configured to be arranged proximate a part of the utility vehicle;

wherein the central system comprises a processing unit and an information transmission unit;

wherein the central system is positioned remotely and independently of the utility vehicle;

wherein the utility vehicle subsystem comprises a transmitter unit, a receiver unit, a processing system and a sensor system;

wherein the sensor system is configured to record at least one dynamic vehicle characteristic value, and transmit the at least one dynamic vehicle characteristic value to the processing system;

wherein the transmitter unit and the receiver unit are configured to transmit the at least one dynamic vehicle characteristic value from the processing system to the central system through the Internet; and wherein the at least one dynamic vehicle characteristic value is selected from the group consisting of: position of the utility vehicle, wheel bearing temperature, current tire pressure, wear state of the brake system and/or of its subcomponents, speed and acceleration of the utility vehicle, position of support winches on the utility vehicle, loading of the axles of the utility vehicle, pressure in air springs of the utility vehicle, an energy state in an energy storage device, position of individual axles of the utility vehicle relative to a body of the utility vehicle, fill level of storage tanks, and brake pressure.

2. The remote monitoring system as claimed in claim 1, wherein the at least one dynamic vehicle characteristic value includes a multiplicity of dynamic vehicle characteristic values.

3. The remote monitoring system as claimed in claim 2, wherein the processing system is configured to code the data transmitted to the transmitter unit and/or decode the data received from the receiver unit.

4. The remote monitoring system as claimed in claim 3, wherein the processing system is configured to store static vehicle characteristic values, wherein the utility vehicle subsystem is configured to transmit and/or transfer the static vehicle characteristic values to the central system following the reception of a request, and wherein the static vehicle characteristic values are selected from the group consisting of: a registration number of the utility vehicle, a construction year of the utility vehicle, a maximum (axle) load, a power of the utility vehicle, a length of the utility vehicle, a height of the utility vehicle, a width of the utility vehicle, a number of axles of the utility vehicle, a date of the next and/or last servicing of the utility vehicle, a last and/or the next date for a main inspection, a type of brakes that are installed, a number of measured values recorded by the sensor system, and a type of measured values recorded by the sensor system.

5. The remote monitoring system as claimed in claim 4, wherein the sensor system has a multiplicity of sensors, and wherein the sensors are each configured to record the at least one dynamic vehicle characteristic value.

6. The remote monitoring system as claimed in claim 5, wherein the central system is configured to transmit data from and/or to at least one information display unit using the information transmission unit.

7. The remote monitoring system as claimed in claim 6, wherein the processing unit is configured to recognize anomalies in the received data, wherein the processing unit is configured, when such an anomaly is present in the received data, to transmit an action recommendation signal to the information transmission unit, and wherein the information transmission unit transmits the action recommendation signal to the utility vehicle subsystem and/or to the information display unit, wherein the action recommendation signal represents an action recommendation selected from the group consisting of: that the utility vehicle should be serviced, that the utility vehicle should be taken to a garage, and that the utility vehicle should be stopped immediately.

8. The remote monitoring system as claimed in claim 7, wherein the subsystem and/or the central system has a software interface and/or a hardware interface.

9. The remote monitoring system as claimed in claim 8, wherein the utility vehicle subsystem has a sensor interface for further sensor systems and/or sensors.

10. The remote monitoring system as claimed in claim 9, wherein the sensor interface includes a plug and/or a socket.

11. The remote monitoring system as claimed in claim 9, wherein the utility vehicle subsystem and/or a sensor system and/or a sensor are manufactured and/or marketed by another manufacturer and/or another provider than that of the utility vehicle and/or of the part of the utility vehicle subsystem.

12. The remote monitoring system as claimed in claim 11, wherein the utility vehicle monitoring system comprises a utility vehicle trailer monitoring system.

13. The remote monitoring system as claimed in claim 1, wherein the processing system is configured to store static vehicle characteristic values, and wherein the utility vehicle subsystem is configured to transmit and/or transfer the static vehicle characteristic values to the central system following the reception of a request, and wherein the static vehicle characteristic values are selected from the group consisting of: a registration number of the utility vehicle, a construction year of the utility vehicle, a maximum (axle) load, a power of the utility vehicle, a length of the utility vehicle, a height of the utility vehicle, a width of the utility vehicle, a number of axles of the utility vehicle, a date of the next and/or last servicing of the utility vehicle, a last and/or the next date for a main inspection, a type of brakes that are installed, a number of measured values recorded by the sensor system, and a type of measured values recorded by the sensor system.

14. The remote monitoring system as claimed in claim 1, wherein the sensor system has a multiplicity of sensors, and wherein the sensors are each configured to record the at least one dynamic vehicle characteristic value.

15. The remote monitoring system as claimed in claim 1, wherein the processing unit is configured to recognize anomalies in the received data, wherein the processing unit is configured, when such an anomaly is present in the received data, to transmit an action recommendation signal to the information transmission unit, and wherein the information transmission unit transmits the action recommendation signal to the utility vehicle subsystem and/or to the information display unit, wherein the action recommendation signal represents an action recommendation selected from the group consisting of: that the utility vehicle should be serviced, that the utility vehicle should be taken to a garage, and that the utility vehicle should be stopped immediately.

16. The remote monitoring system as claimed in claim 1, wherein the utility vehicle subsystem and/or the central system has a software interface and/or a hardware interface.

17. The remote monitoring system as claimed in claim 1, wherein the utility vehicle subsystem has a sensor interface for further sensor systems and/or sensors.

18. The remote monitoring system as claimed in claim 17, wherein the sensor interface includes a plug and/or a socket.

19. The remote monitoring system as claimed in claim 1, wherein the utility vehicle subsystem and/or a sensor system and/or a sensor are manufactured and/or marketed by another manufacturer and/or another provider than that of the utility vehicle and/or of the part of the utility vehicle subsystem.

20. The remote monitoring system as claimed in claim 1, wherein the utility vehicle monitoring system comprises a utility vehicle trailer monitoring system.

21. A remote The monitoring system for a utility vehicle, comprising:

a utility vehicle subsystem; and a central system, wherein the utility vehicle subsystem is configured to be arranged proximate a part of the utility vehicle, wherein the central system comprises a processing unit and an information transmission unit, wherein the central system is positioned independently of the utility vehicle, wherein the utility vehicle subsystem comprises a transmitter unit, a receiver unit, a processing system and a sensor system, wherein the sensor system is configured to record at least one dynamic vehicle characteristic value, and transmit the at least one dynamic vehicle characteristic value to the processing system, wherein the transmitter unit and the receiver unit are configured to transmit the at least one dynamic vehicle characteristic value from the processing system to the central system, wherein the at least one dynamic vehicle characteristic value is selected from the group consisting of: position of the utility vehicle, wheel bearing temperature, current tire pressure, wear state of the brake system and/or of its subcomponents, speed and acceleration of the utility vehicle, position of support winches on the utility vehicle, loading of the axles of the utility vehicle, pressure in air springs of the utility vehicle, an energy state in an energy storage device, position of individual axles of the utility vehicle relative to a body of the utility vehicle, fill level of storage tanks, and brake pressure, and wherein the processing system is configured to code the data transmitted to the transmitter unit and/or decode the data received from the receiver unit.

22. A remote monitoring system for a utility vehicle, comprising:

a utility vehicle subsystem; and a central system, wherein the utility vehicle subsystem is configured to be arranged proximate a part of the utility vehicle, wherein the central system comprises a processing unit and an information transmission unit, wherein the central system is positioned independently of the utility vehicle, wherein the utility vehicle subsystem comprises a transmitter unit, a receiver unit, a processing system and a sensor system, wherein the sensor system is configured to record at least one dynamic vehicle characteristic value, and transmit the at least one dynamic vehicle characteristic value to the processing system, wherein the transmitter unit and the receiver unit are configured to transmit the at least one dynamic vehicle characteristic value from the processing system to the central system, wherein the at least one dynamic vehicle characteristic value is selected from the group consisting of: position of the utility vehicle, wheel bearing temperature, current tire pressure, wear state of the brake system and/or of its subcomponents, speed and acceleration of the utility vehicle, position of support winches on the utility vehicle, loading of the axles of the utility vehicle, pressure in air springs of the utility vehicle, an energy state in an energy storage device, position of individual axles of the utility vehicle relative to a body of the utility vehicle, fill level of storage tanks, and brake pressure, and wherein the central system is configured to transmit data from and/or to at least one information display unit using the information transmission unit.

* * * * *